US005256096A

United States Patent [19]

Lagos

[11] Patent Number: 5,256,096

[45] Date of Patent: * Oct. 26, 1993

[54] FLUORESCENT LAMP WITH IMPROVED PHOSPHOR COATING AND RELATED PROCESS

[76] Inventor: Costas C. Lagos, 16 Linden Dr., Danvers, Mass. 01923

[ * ] Notice: The portion of the term of this patent subsequent to Sep. 3, 2008 has been disclaimed.

[21] Appl. No.: 729,251

[22] Filed: Jul. 12, 1991

Related U.S. Application Data

[63] Continuation-in-part of Ser. No. 457,004, Dec. 22, 1989, Pat. No. 5,045,008.

[51] Int. Cl.[5] ..... H01J 9/22

[52] U.S. Cl. ..... 445/26; 427/67; 445/58

[58] Field of Search ..... 427/67; 445/26, 58; 252/301.4 P

[56] References Cited

U.S. PATENT DOCUMENTS

| | | | |
|---|---|---|---|
| 2,987,414 | 6/1961 | Martyny | 427/67 |
| 3,023,340 | 2/1962 | Repsher | 252/301.4 P X |
| 4,208,448 | 6/1980 | Panaccione | 427/67 |
| 4,401,276 | 8/1983 | Arbie | 252/301.4 P X |
| 4,826,622 | 5/1989 | Gingerich et al. | 252/301.4 P |
| 4,897,217 | 1/1990 | Jackson . | |
| 5,045,008 | 9/1991 | Lagos | 427/67 |

OTHER PUBLICATIONS

Szegvari and Yang, "Attritor Grinding and Dispersing Equipment," Union Process Inc., Akron Ohio. Date unknown.

*Primary Examiner*—Kenneth J. Ramsey

*Attorney, Agent, or Firm*—Robert E. Walter; Elizabeth A. Levy

[57] ABSTRACT

A fluorescent lamp including a lamp bulb which has been coated with phosphor powder which has been ground in an attritor to reduce the powder weight without loss in light output and light maintenance. A process to produce such a fluorescent lamp utilizes a particular sequence of steps including firing, milling, attritor milling, and washing to produce an improved stir-in alkaline earth halophosphate.

6 Claims, 2 Drawing Sheets

FLUORESCENT LAMP WITH IMPROVED PHOSPHOR COATING AND RELATED PROCESS

BACKGROUND OF THE INVENTION

This application is a continuation-in-part application of parent copending application Ser. No. 07/457,004, filed Dec. 22, 1989, to Costas C. Lagos, and entitled Fluorescent Lamp with Improved Phosphor Coating and Related Process, now U.S. Pat. No. 5,045,008.

FIELD OF THE INVENTION

The present invention relates to a fluorescent lamp which includes a conventional bulb containing therein a coating of phosphor powder. The phosphor powder used has been ground to provide a substantial decrease in fluorescent lamp phosphor powder weight without any loss in light output.

DESCRIPTION OF THE PRIOR ART

Fluorescent lamps have various shapes and forms. One typical fluorescent lamp is in the form of an elongated soda-lime silicate glass bulb having a circular cross section. The lamp includes a conventional discharge assembly including an electrode structure at each end of the bulb supported therein by lead-in wires which are sealed in and extend through a glass seal in a stem mount to the contacts of a lamp base affixed to opposite ends of the lamp. The sealed glass tube contains a conventional discharge sustaining filling. The inner surface of the elongated glass bulb is coated with phosphor, the phosphor coating typically covering the entire length of the inner wall of the bulb. The lamp is coated in a conventional manner. One of the factors considered during the phosphor coating operation is that the coating be effected to the extent required to obtain the desired degree of light output. The coating process is an important factor in defining the lamp optical density and lumen output. In evaluating these factors it has been observed that the average particle size of the phosphor powder is an important consideration in obtaining the desired results. Ordinarily there will be a distribution of bright, coarser phosphor particles in the 17 to 35 micron range, intermediate-sized bright phosphor particles in the 6 to 13 micron range, and lower brightness particles in the 3 to 6 micron range. In using conventional phosphor powder, a given powder weight will be required depending upon the specific make-up of the phosphor powder and the desired results. One problem encountered in coating a bulb with conventional phosphor powder is that the presence of the coarser particles provides a smaller powder surface area within the bulb, thereby providing less than optimum lamp coating coverage. To obtain the desired optical density, a higher than desired total phosphor weight is required. This adds to the cost of the lamp.

It is an object of the present invention to provide a method of coating a fluorescent lamp with phosphor powder which has been ground to the extent that there is a substantial decrease in phosphor powder weight without any loss in light output. It is a further object of the present invention to provide such a method wherein the reduction in phosphor powder weight provides a substantial savings in phosphor cost. It is another object of the present invention to provide a method which allows for a decrease in phosphor powder weight at the same lam density and lumen output as was obtained heretofore with the use of conventional unground phosphor. Yet another object of the present invention is to provide a fluorescent lamp which embodies the foregoing characteristics.

SUMMARY OF INVENTION

This invention achieves these and other results by providing a fluorescent lamp, and method of forming same, having a light-transmissive envelope which encloses means for converting electrical energy into fluorescent light including an improved phosphor coating. The improved phosphor coating comprises an attritor phosphor powder as described herein.

This invention relates to the utilization of an attritor grinding mill as an additional step in a process as generally described in U.S. Pat. No. 4,897,217 to Jackson et al.

In accordance with the present invention, there is provided a method of producing a fluorescent lamp of the type utilizing a alkaline earth halophosphate stir-in phosphor, said method comprising the steps of:

forming a uniform mixture of starting raw materials in sufficient amounts to produce a desired alkaline earth halophosphate, firing said mixture in a non-reacting atmosphere at a temperature of from about 600 degrees Centigrade to about 1300 degrees Centigrade for a sufficient time to produce a fired material containing said phosphor, milling said fired material in an aqueous medium, wet screening the resulting milled material through a screen of greater than about 300 mesh, attritor grinding said wet screened phosphor powder to form attritor phosphor powder having a reduced average particle size relative to the average particle size of said conventional phosphor powder;

washing said attritor phosphor powder in an aqueous mineral acid and subsequently washing said acid washed attritor phosphor in an aqueous base having a pH of from about 7.0 to about 9.0, suspending said attritor phosphor powder in a liquid;

coating the inside of a lamp bulb with said suspended attritor phosphor powder;

drying said coating of attritor phosphor powder;

baking said dried attritor phosphor powder;

attaching a discharge assembly including electrodes to said lamp bulb;

subjecting said lamp bulb to vacuum and introducing a fill material therein; and sealing said lamp bulb.

DESCRIPTION OF THE PREFERRED EMBODIMENT

Figure 1:
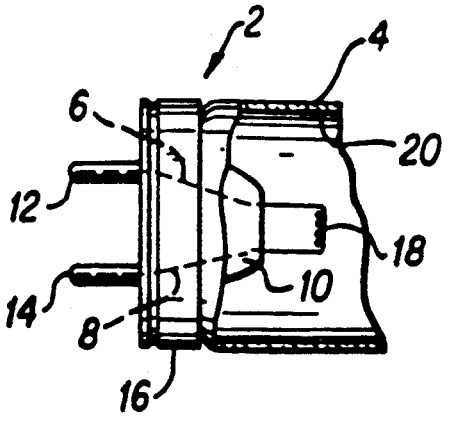
FIG. 1 is a cross-sectional view of one end of a fluorescent lamp embodying the present invention.
Figure 4:
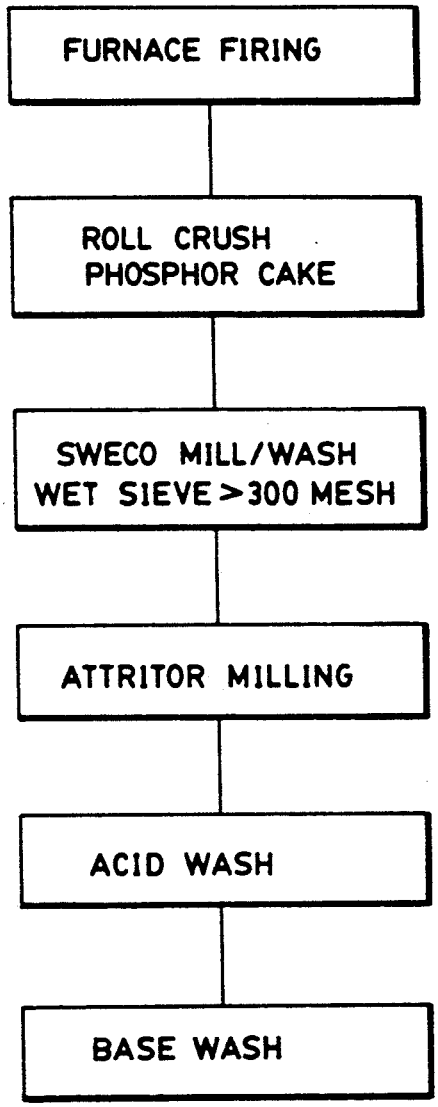
FIG. 4 is a block diagram of the process of the present invention.

The embodiment of this invention, which is illustrated in FIG. 4, is particularly suited for achieving the objects of this invention. FIG. 1 depicts one end of an elongated fluorescent lamp 2 which includes an elongated light-transmissive sealed bulb 4 having a circular cross section. A discharge assembly is provided which includes lead-in wires 6 and 8 which are sealed in and extend through a glass seal in a stem mount 10. One end of each lead-in wire 6 and 8 is electrically connected to the contacts 12 and 14, respectively, of the base 16 in a known manner. The opposite end of each lead-in wire 6 and 8 is electrically connected to an electrode 18 as depicted in the drawing. The bulb 4 is subjected to vacuum and contains a conventional discharge sustaining filling such as mercury. The envelope is sealed in a known manner. The lamp thus far described is representative of a typical prior art fluorescent lamp.

The inner surface of the elongated glass bulb 4 is coated with a phosphor powder. Although such bulbs are typically coated with phosphor powder, in the present invention the bulb 4 is coated with phosphor powder 20 which has been processed to obtain structural features not present in prior art fluorescent lamps.

It has been discovered that by grinding phosphor powder using an attritor, a substantial decrease in fluorescent lamp phosphor powder weight can be achieved without any loss in light output. The practical effect of such a reduction in weight is that a substantial savings in the cost of phosphor can be obtained without loss of lamp optical density and lumen output. In other words, the decrease in the weight of phosphor powder obtained by using the attritor to grind the powder is accomplished such that the attritor-ground phosphor powder has the same optical density and lumen output previously obtained with the use of conventional unground phosphor powder used in conventional fluorescent lamps.

It has also been discovered that during the grinding process using the attritor, most of the grinding action is done on the bright, coarser phosphor particles which are in the 17 to 35 micron range. The result is that such grinding of the coarser particles produces more of the intermediate sized bright phosphor particles in the 7 to 13 micron range and less of the coarser particles. In the grinding of conventional phosphor powder done to date, it has been observed that there is a reduction in the average particle size relative to that of conventional unground phosphor powder of about fifteen percent. Quite unexpectedly, fewer of the lower brightness particles in the 3 to 6 micron range are formed during the attritor grinding than would be obtained using other grinding methods such as ball milling. The decrease in the quantity of the bright, coarser particles provides a slightly larger powder surface area. This provides better lamp coating coverage and results in the same optical density at a lower total phosphor powder weight. Since there is no substantial increase in the dimmer, smaller phosphor particles, there is no decrease in lamp output.

The starting phosphor utilized has a powder distribution comprising a distribution of large size particles and medium size particles which are relatively bright particles having a desired brightness for lamp use. The starting powder additionally includes another distribution of small size particles which are dimmer than the large and medium sized particles. The attritor milling desirably decreases the amount of particles within the distribution of large size particles without substantially increasing the amount of particles in the small size distribution.

Table 1 compares particle size distribution changes, as determined in a conventional manner using a Leeds and Northrup Microtrac instrument, of conventional cool white (CW) halophosphate phosphor in an unground "as-is" condition to the same phosphor powder after being subjected to a fifteen minute grind in a Union Process Model 01-HD attritor set at 125 rotations per minute:

TABLE 1

| Instrument Particle Size Channel Midpoints (Microns) | Phosphor As-Is | % By Volume Each Channel 15 Minutes Attritor Grind |
|---|---|---|
| 35.5 | 5 | 0 |
| 25.1 | 18 | 14 |
| 17.75 | 33 | 31 |
| 12.55 | 24 | 25 |
| 8.87 | 11 | 16 |
| 6.27 | 7 | 9 |
| 4.43 | 0 | 2 |
| 3.13 | 0 | 1 |

The mean particle size for the "as-is" phosphor was 16.9 microns as compared to 14.4 microns for the attritor ground phosphor.

The improved phosphor powder of the present invention is referred to herein as an "attritor phosphor powder." The term "attritor phosphor powder" as used herein is defined to mean any conventional phosphor powder, for use in a fluorescent lamp, which has been ground in an attritor to the extent to affect in a fluorescent lamp a decrease in phosphor powder weight without loss of lamp optical density and lumen output when compared to conventional phosphor powder which has not been ground in an attritor. In order to understand the processing of attritor phosphor powder, an understanding of attritor grinding equipment will be helpful.

Attritors of the type contemplated by the present invention include, without limitation, those attritors described in detail in a publication entitled "Attritor Grinding And Dispensing Equipment" by A. Szegvari and M. Yang of the Union Process Inc., Akron, Ohio. This publication is incorporated by reference herein. As discussed in this publication the attritor provides very efficient comminuting. Generally, the attritor is a grinding mill containing internal media which is agitated at moderate speeds, relative to a typical ball mill, to achieve grinding. In essence, the contents of the attritor are stirred as the mill is being rolled. However, the attritor can operate up to ten times as fast as a typical ball mill in grinding action to produce finer, homogeneous dispersions with a narrow particle size distribution.

Figure 2:
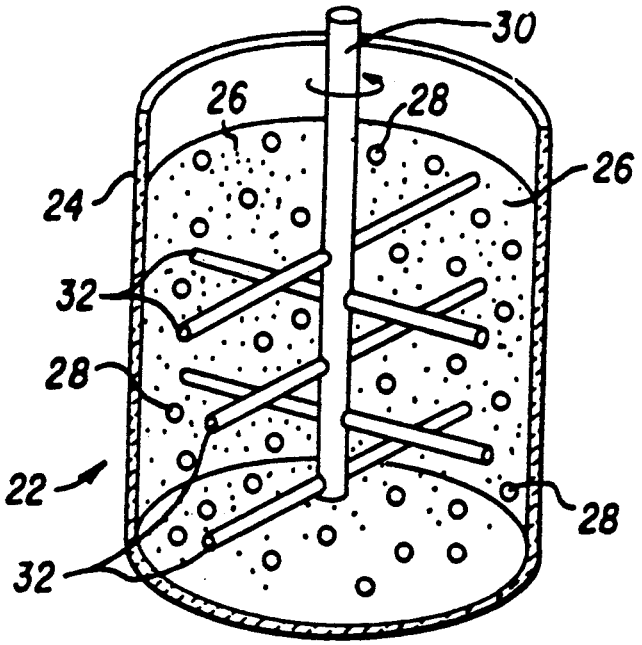
FIG. 2 is a cross-sectional view of an attritor useful in the present invention.

FIG. 2 diagrammatically depicts an example of an attritor useful in the present invention. In particular, an attritor 22 is provided, including a stationary tank 24, into which is placed (a) the material to be ground and (b) the grinding media. In FIG. 2, the material to be ground is phosphor powder 26 and the grinding media is small alumina balls 28. The phosphor powder 26 and the small alumina balls 28 are then agitated by a rotating internal shaft 30 having a plurality of arms 32. The shaft 30 and agitator arms 32 are plastic coated steel, and the rotational speed can be varied. Conventional phosphor powder ground in an attritor such as, for example, attritor 22, will be transformed into attritor phosphor powder as described herein.

Table 2 records various results obtained from four specimens which were tested in GTE Sylvania 40T12 Cool White (CW) fluorescent lamps. Each fluorescent lamp test group of four lamps was identical except for the phosphor powder coating as noted below. The phosphor represented by the test specimens A to D came from the same batch of CW halophosphate phosphor powders. Specimen A represents such phosphor in the "as-is" condition. Specimen B represents another "as-is" sample, but one that has been subjected to an acid-base (AB) washing procedure. Such A-B washing procedure involves washing the phosphor powder for 30 minutes by stirring 350 grams of the phosphor in a dilute acid solution such as 3 ml of HCl per liter of deionized water. This is followed by a deionized water rinse to remove the acid. A final washing step follows using a dilute basic solution of 3 mil $NH_4OH$ per liter of deionized water. This HCl acid-$NH_4$ base washing procedure removes from the powder any small amounts of unreacted raw materials and any other minute impurities that might be present as a result of the conventional phosphor post-firing processing. Improvements in lamp output and maintenance are achieved with the use of the A-B washing procedure. Specimen C represents phosphor which has been ground in a Union Process Model 01-HD attritor but not subjected to the A-B washing procedure. Specimen D represents phosphor which has been ground in an attritor and also subjected to the A-B washing procedure. In processing specimen D, the attritor grinding step was incorporated in an acid portion of the A-B wash. A Union Process Model 01-HD attritor was used and the powder was ground for 15 minutes. Rotation of the attritor internal shaft was set at about 125 rotations per minute. The actual procedure involved attritor grinding 350 grams of phosphor in the acid solution followed by a 15 minute stir wash in acid solution for the total acid wash of 30 minutes. The rest of the standard A-B wash procedure discussed above, that is, water rinsing and a 30 minute base wash, was then performed on the attritor ground sample.

Lamp test groups 1 to 4 were coated with specimens A to D, respectively, in a conventional manner. The test results are noted below:

TABLE 2

| Lamp Test Groups | Specimen | Corrected Powder Weight (Avg.) | 100 Hour Lumens (Avg.) | % M 0–100 (Avg.) |
|---|---|---|---|---|
| 1 | A | 7.60 g | 3200 | 97.7 |
| 2 | B | 7.94 g | 3201 | 97.6 |
| 3 | C | 6.34 g | 3133 | 95.8 |
| 4 | D | 6.57 g | 3213 | 98.0 |

It is evident from Table 2 that the attritor ground and A-B washed sample used in Lamp Test Group 4 (Specimen D) resulted in a gain of 13 lumens and a decrease lamp powder weight of 1.03 grams relative to specimens A and B. This amounts to a phosphor cost savings of about 13.6 percent.

A number of repeat lamp tests were conducted using samples of CW halophosphate phosphors obtained from the same lot. Four fluorescent lamps, identified as Test Group 1, were coated with conventional phosphor in an "as-is" condition and subjected to the A-B washing procedure discussed above. Another four fluorescent lamps, identified as Test Group 2, were coated with phosphor from the same lot which was ground for fifteen minutes in the acid portion of the A-B wash using a Union Process Model 01-HD attritor. The internal shaft of the attritor was rotated at about 125 rotations per minute. In particular, as to the phosphor powder used to coat the lamps of Test Group 2, a 1000 ml volume alumina grinding chamber was positioned on an attritor stand such that there was about ¼" space between the inside bottom of the chamber and the bottom of the plastic coated stirring shaft. Next, 1200 grams of 3/16" diameter alumina balls were placed in the ceramic chamber. Then 200 ml of solution taken from 1200 ml of an acid solution (HCl concentration of 3 ml/liter) was added to the ceramic chamber. The remaining 1000 ml of the acid solution was retained for rinsing of the ground phosphor from the alumina balls and for the rest of the washing step as described herein. While the stirrer was rotated, 350 grams of CW halophosphate phosphor powder was then added to the attritor grinding chamber. After all such phosphor powder was added, the phosphor powder was ground for 15 minutes in the chamber.

After 15 minutes elapsed, rotation of the shaft and agitator arms was stopped and the entire contents of the ceramic chamber was poured over a fine mesh plastic screen in order to remove the 3/16" grinding media. The grinding media was then rinsed with the remaining 1000 ml of acid solution mentioned previously to remove the phosphor powder. The phosphor powder and the phosphor grinding and media rinse solutions were then all combined in a two liter plastic beaker and the entire suspension was stirred for an additional 15 minutes using a plastic propeller stirrer driven at a speed fast enough to prevent the phosphor powder from settling in the beaker.

At the end of 15 minutes of stirring the suspension was filtered through a Buechner funnel on which it was then washed six times with deionized water. A wet phosphor cake so formed was removed from the funnel and placed in a 2 liter plastic beaker with 1200 ml of basic solution (3 ml $NH_4OH$ per liter $H_2O$) and stirred using a plastic propeller stirrer as previously discussed. At the end of 30 minutes the suspension was again filtered through a Buechner funnel. No water washing was done on the phosphor while it was on the filter. After drying in an oven at 160° C., the phosphor was passed through a course sieve (60 mesh) to break up any clumps and/or large agglomerates. The specimen obtained as a result of the foregoing process was applied to the lamps of Test Group 2.

Table 3 records data similar to Table 2 for the lamps of Test Group 1 and Test Group 2, the recorded data being averaged over five individual tests:

TABLE 3

| Lamps | Corrected Powder Weight (Avg.) | 100 Hour Lumens (Avg.) | % M 0–100 Average |
|---|---|---|---|
| Test Group 1 | 7.4 grams | 3172 | 97.1% |
| Test Group 2 | 6.6 grams | 3169 | 97.2% |

It is evident from Table 3 that there is a significant decrease in lamp phosphor powder weights (0.8 grams) without any significant change in lumen output or maintenance. This will amount to a phosphor cost savings of about 11%.

As noted above, the foregoing process was performed using a Union Process Model 01-HD attritor. It will be apparent to those skilled in the art that a larger continuous attritor can be used in production. As also noted above, the attritor was used to grind conventional ready-to-use CW halophosphate powders. However, the present invention is not limited to the processing of CW halophosphate phosphor powders. For example, any phosphor useful in a fluorescent lamp can be subjected to the process of the present invention. It will also be apparent to those skilled in the art that attritor treatment might be different for other types of phosphors depending upon particle size, method of phosphor preparation, or the nature of the specific phosphor composition. Such a variation in treatment might require, for example, that the attritor speed be varied. Similarly, grinding solution concentrations might be changed and different grinding solutions might be utilized. In addition, the size and quantities of the grinding media might vary. Further, grinding time might also vary. In a like manner, grinding solutions and post grinding solutions might vary.

Figure 3:
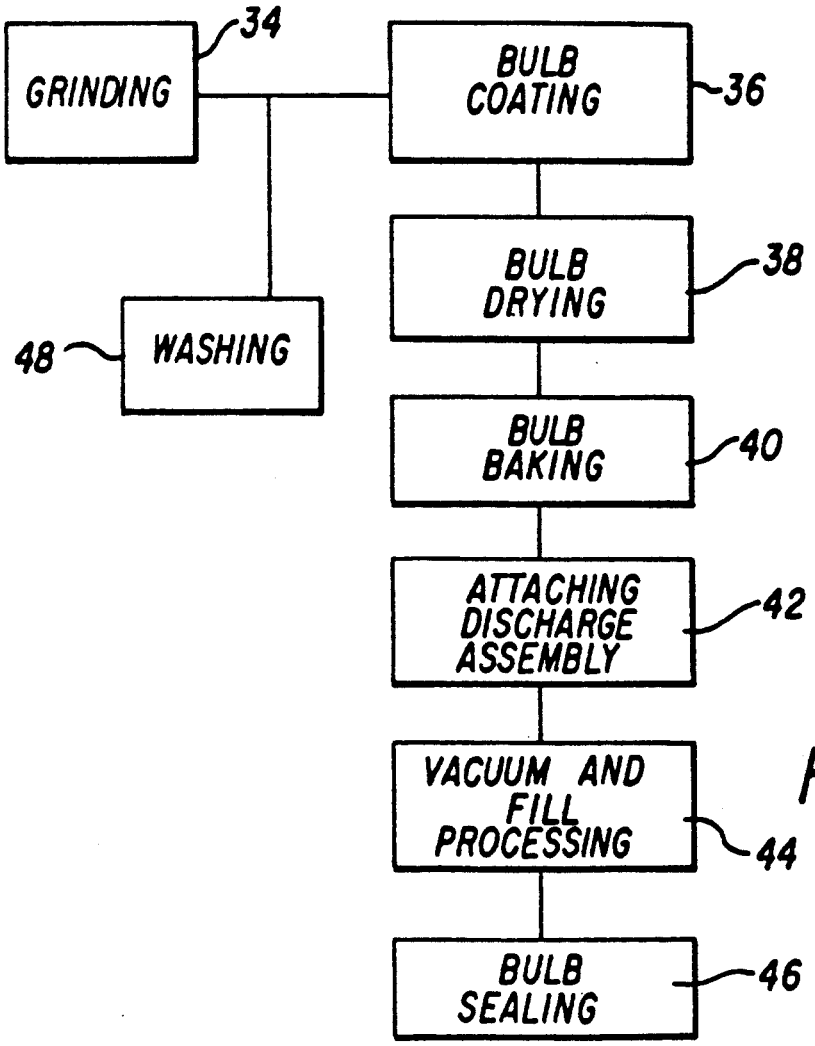
FIG. 3 is a block diagram of the process of the present invention.

Referring to the block diagram of FIG. 3, the invention includes a process to produce a fluorescent lamp wherein the phosphor is ground (34) using an attritor to form attritor phosphor powder. A typical commercial fluorescent lamp producing process is then followed wherein the attritor phosphor powder so formed is suspended in a liquid and the lamp bulb is coated therewith (36). Then the bulb is dried (38), typically to remove any solvent present in the powder. Subsequently, the bulb is baked (40) to remove any organic material present in the powder. Finally, the discharge assembly including electrodes as depicted in FIG. 1 is attached (42) to the lamp, the lamp is subjected to vacuum and a fill such as mercury is introduced therein (44), and the bulb is sealed (46). In the preferred embodiment, the attritor phosphor powder is washed (48) subsequent to the grinding step as, for example, by first washing in an acid solution and then washing in a base solution.

Most of the attritor grinding action is done on the brighter, coarser phosphor particles which are in the 17 to 35 micron size range. When these coarser particles are ground, more of the intermediate sized (about 6 to 13 microns) bright phosphor particles are formed. Fewer of the lower brightness particles (about 3-6 microns) are formed when the attritor is used to grind the phosphor than would be obtained through the use of other grinding techniques such as ball milling or vibratory milling.

The phosphors that are made by the process of the present invention are alkaline earth halophosphates for use in fluorescent tubes. They have the general formula $Ca_5(F_{1-x},Cl_x)(PO_4)_3$:Sb:Mn as specifically described in U.S. Pat. No. 4,897,217 to Jackson, the specification of which is incorporated by reference into the present application. Particularly, the portion of the disclosure relating to the formulation and firing of the phosphors. Additional portions of the specification are incorporated to the extent that they aid in understanding the present invention.

With reference to FIG. 4, the process of the present invention is set forth in schematic form. The preparation of the phosphors and furnace firing is as U.S. Pat. No. 4,897,217 to Jackson, the specification of which is incorporated by reference into the present application.

As set forth in U.S. Pat. No. 4,897,217, the resulting fired material is normally finger crushed and roll crushed. This is preferably performed with a finger crusher made by Jacobson. This step is illustrated in FIG. 4 as ROLL CRUSH PHOSPHOR CAKE.

The resulting fired and crushed material is then milled in an aqueous liquid medium, preferably water with the addition of an acid or a base. In accordance with the present invention, it is preferable to acid and base wash after the attritor mill step. The milling is normally for a length of time of about 1.5 hours to about 4 hours for about 1000 kg of material. The milling is done preferably in a vibratory mill such as that manufactured by SWECO. The vibratory milling process breaks up agglomerated phosphor particles. It is contemplated that a chelating agent be present in the aqueous milling medium as an aid in removing ions from the resulting slurry. Typical chelating agents comprise ethylenediaminetetraacetic acid. U.S. Pat. No. 3,757,938 describes the use of a diethylene triamine pentacetic acid chelating agent as an aid in removing ultrafine particles which remain in suspension. Such a chelating agent may be utilized in conjunction with or after such milling operation.

The resulting milled material is then wet screened directly from the milling operation through a first screen of greater than about 300 mesh as set forth in the above patent. The higher the mesh size, the longer milling time. The mesh size is important since a smaller wet classified particles result in smaller dry classified particles and reduction of coarse particles.

This above described milling and sieving steps are illustrated in FIG. 4 as SWECO MILL/WASH. Next, the resulting phosphor powder is fed to an attritor mill as shown in FIG. 4 as ATTRITOR MILLING. The attritor is a combination attritor and a large holding tank which is generally about five, and preferably about ten times the size of the attritor. The attritor is filled with media and contains grids which restrain the media while the slurry is allowed to pass through. The attritor is equipped with a high circulating pump which circulates the entire contents of the holding tank through the attritor at least about five, and preferably about seven times per hour.

Table 4 compares particle size distribution changes, as determined in a conventional manner using a Leeds and Northrup Microtrac instrument, of conventional cool white (CW) halophosphate phosphor in an unground "as-is" condition compared to the same phosphor powder after being subjected to a five minute grind in a Union Process Model Q-2 attritor with holding tank, available from Union Process Inc., Akron, Ohio, set at 125 rotations per minute:

TABLE 4

| Instrument Particle Size Channel Midpoints (Microns) | Phosphor As-Is | % By Volume Each Channel 15 Minutes Attritor Grind |
|---|---|---|
| 35.5 | 1 | 0 |
| 25.1 | 12 | 9 |
| 17.75 | 31 | 27 |
| 12.55 | 29 | 29 |
| 8.87 | 12 | 14 |
| 6.27 | 7 | 9 |
| 4.43 | 4 | 5 |

The mean particle size for the "as-is" phosphor was 14.79 microns as compared to 13.32 microns for the attritor ground phosphor.

Next, the resulting attritor milled phosphor is washed with a mineral acid followed by washing with a basic aqueous solution to wash any freshly exposed surface. This step removes impurities including unreacted starting materials. This acid wash followed by a basic wash is as previously set forth in this application. It is also contemplated that an organic acid as described in U.S. Pat. No. 4,897,217 may be utilized. Typical organic acids include acetic acid and carbonic acid.

As set forth in the above patent, the resulting material may additionally be suspended in water to result in a specific gravity of from about 1,300 to about 1,400 and screened through a screen of greater than about 350 mesh. This step may be performed after the acid wash and before the wash with an aqueous basic solution.

The drying of the phosphor may be performed as set forth in the above patent. As noted, the specific treatment parameters will be readily apparent to those skilled in the art depending upon the nature of the phosphor powder being processed and the desired final result in terms of reduction in powder weight for a particular lamp application. In summary, in accordance with the teachings of the present invention, all of the foregoing parameters might be varied to obtain the desired results. What is required, however, is that the phosphor be attritor ground to provide a substantial reduction of the average particle size of ready-to-use conventional phosphor powder such that the use of the ground phosphor powder in fluorescent lamps will result in a substantial lower lamp phosphor powder weight, relative to the conventional unground powder, with no loss in light output and light maintenance.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A method of producing a fluorescent lamp of the type utilizing a alkaline earth halophosphate stir-in phosphor, said method comprising the steps of:

forming a uniform mixture of starting raw materials in sufficient amounts to produce a desired alkaline earth halophosphate;

firing said mixture in a non-reacting atmosphere at a temperature of from about 600 degrees Centigrade to about 1300 degrees Centigrade for a sufficient time to produce a fired material containing said phosphor;

milling said fired material in an aqueous medium, wet screening the resulting milled material through a screen of greater than about 300 mesh, said wet screened phosphor powder having a large size particle distribution and a small size particle distribution;

attritor grinding said wet screened phosphor powder to form attritor phosphor powder having a reduced average particle size relative to the average particle size of said conventional phosphor powder, said attritor grinding being immediately after said wet screening wherein said attritor milling desirably decreases the amount of particles within said distribution of large size particles without substantially increasing the amount of particles in the small size distribution;

washing said attritor phosphor powder in an aqueous mineral acid and subsequently washing said acid washed attritor phosphor in an aqueous base having a pH of from about 7.0 to about 9.0;

suspending said attritor phosphor powder in a liquid;

coating the inside of a lamp bulb with said suspended attritor phosphor powder;

drying said coating of attritor phosphor powder;

baking said dried attritor phosphor powder;

attaching a discharge assembly including electrodes to said lamp bulb;

subjecting said lamp bulb to vacuum and introducing a fill material therein; and sealing said lamp bulb.

2. A method as described in claim 1 wherein said attritor milling is performed by forming a slurry comprising said phosphor powder, circulation said slurry during attritor milling by withdrawing said slurry from one portion of said attritor mill and returning said removed slurry to another portion of said mill for regrinding.

3. A method as described in claim 2 wherein said grinding step includes the further steps of:

placing a grinding media in an attritor grinding chamber;

adding an aqueous milling medium to said grinding chamber;

adding said phosphor powder to said grinding chamber to form a slurry; and grinding the contents of said grinding chamber while circulating said slurry through said attritor mill at greater than about five times per hour.

4. A method as described in claim 3 wherein said grinding step includes the further step of rotating an attritor stirrer after adding said aqueous solution and while adding said phosphor powder.

5. A method as described in claim 4 wherein said washing step includes the further steps of:

adding an HCl acid solution to said attritor phosphor powder.

6. A method as described in claim 5 wherein said base solution is $NH_4OH$.

* * * * *